US006926597B2

(12) United States Patent
Sangster et al.

(10) Patent No.: US 6,926,597 B2
(45) Date of Patent: Aug. 9, 2005

(54) INTERMEDIATE LENS PAD

(75) Inventors: Clive L. Sangster, East Sussex (GB); Clifford M. Giles, Kent (GB); Timothy Noakes, Kent (GB)

(73) Assignee: Cerium Group Limited, London (GB)

( * ) Notice: Subject to any disclaimer, the term of this patent is extended or adjusted under 35 U.S.C. 154(b) by 0 days.

(21) Appl. No.: 10/879,155

(22) Filed: Jun. 30, 2004

(65) Prior Publication Data

US 2004/0235400 A1 Nov. 25, 2004

Related U.S. Application Data

(62) Division of application No. 09/922,928, filed on Aug. 7, 2001.

(30) Foreign Application Priority Data

Aug. 7, 2000 (GB) ..... 0019294

(51) Int. Cl.[7] ..... B24D 11/00
(52) U.S. Cl. ..... 451/527; 451/42
(58) Field of Search ..... 451/527, 42–44, 451/255–256, 277, 293, 298, 295

(56) References Cited

U.S. PATENT DOCUMENTS

| | | | | |
|---|---|---|---|---|
| 4,274,232 A | | 6/1981 | Wylde | |
| 4,920,700 A | * | 5/1990 | Murahashi et al. | 451/277 |
| 5,095,660 A | * | 3/1992 | Dillon | 451/163 |
| 5,384,988 A | | 1/1995 | Hernandez | |
| 6,074,290 A | | 6/2000 | Ko et al. | |
| 6,375,554 B1 | * | 4/2002 | Murray et al. | 451/42 |
| 6,478,657 B1 | * | 11/2002 | Shibata | 451/5 |
| 2002/0025765 A1 | * | 2/2002 | Sangster et al. | 451/42 |
| 2003/0114084 A1 | * | 6/2003 | Moon et al. | 451/36 |

FOREIGN PATENT DOCUMENTS

| | | |
|---|---|---|
| GB | 1 039 810 | 8/1980 |
| GB | 1 599 659 | 10/1981 |
| JP | 10165515 | 6/1998 |
| JP | 11321871 | 11/1999 |

* cited by examiner

*Primary Examiner*—Lee D Wilson
(74) *Attorney, Agent, or Firm*—Dickstein Shapiro Morin & Oshinsky LLP

(57) ABSTRACT

An intermediate lens pad having a side secured to curved surface of a lens tool when the pad is in use. The pad has a surface on its other side which is substantially smooth, but which is formed with a multiplicity of substantially uniformly distributed holes or recesses which are at least of an order of magnitude smaller than the pad itself, or the surface is defined by the outer surfaces of a multiplicity of protuberances uniformly distributed over the pad such that the minimum space between adjacent protuberances is of an order of magnitude smaller than the pad itself. A lens surfacing pad having a peel-off adhesive on one side and a working surface on its other side, can be secured by its adhesive side to the intermediate pad so that it inhibits movement between the pads during surfacing, whilst allowing manual removal of the surfacing pad for replacement.

2 Claims, 4 Drawing Sheets

INTERMEDIATE LENS PAD

This application is a divisional of U.S. patent application Ser. No. 09/922,928, filed Aug. 7, 2001, entitled INTERMEDIATE LENS PAD, which claims priority to U.K. patent application 0019294.8, filed Aug. 7, 2000, of the same title. The entirety of these applications is hereby incorporated by reference herein.

BACKGROUND

The present invention relates to an intermediate lens pad.

An example of such a lens pad is described and illustrated in GB-A-2039810. It is sandwiched between a lens tool and a surfacing pad, and adjusts the effective curvature of the tool. The surfacing pad may be secured to the intermediate pad either by adhesive or by friction grip.

A drawback of the use of adhesive is that it is difficult to remove the surfacing pad for a subsequent operation using the same tool. Whilst the friction grip method overcomes this problem, it can result in movement of the surfacing pad, so as to create defects in the curvature of the finished lens, and particles from the friction grip surface may work loose and possibly even scratch the surface of the lens.

It will be appreciated here that these problems arise regardless of whether the intermediate pad is a correcting pad. They arise as a result of the need to be able to change the surfacing pad.

The present invention seeks to provide a remedy.

SUMMARY

Accordingly, the present invention is directed to an intermediate lens pad having a first side which is secured to the curved surface of a lens tool when the pad is in use, and a surface on its other side which is substantially smooth, but which is open in the sense that the said surface is formed with a multiplicity of substantially uniformly distributed holes or recesses which are at least of an order of magnitude smaller than the pad itself, or in the sense that the said surface is defined by the outer surfaces of a multiplicity of protuberances uniformly distributed over the pad such that the minimum space between adjacent protuberances is of an order of magnitude smaller than the pad itself, whereby a lens surfacing pad having a peel-off adhesive on one side and a working surface on its other side, can be secured by its adhesive side to the intermediate pad to an extent which inhibits relative movement between the pads during surfacing, whilst allowing ready manual removal of the surfacing pad for replacement by a different surfacing pad.

The present invention extends to a combination of a lens tool, an intermediate lens pad having the construction set out in the immediate preceding paragraph, and a lens surfacing pad also having the construction set out in the immediately preceding paragraph, secured by its adhesive side to the intermediate pad.

The holes or recesses or spaces may each have a diameter or width substantially in the range from 0.2 mm to 8 mm.

The holes, recesses or protuberances are preferably arranged in honeycomb formation.

The material of the intermediate lens pad preferably comprises a plastics material, preferably polyvinyl chloride.

The present invention also extends to a method of surfacing a lens using a lens tool assembly in accordance with the present invention.

An example of an intermediate lens pad and a lens tool and pad combination in accordance with the present invention will now be described with reference to the accompanying drawings in which:

DETAILED DESCRIPTION OF A PREFERRED EMBODIMENT

The following description illustrates embodiments of an intermediate lens pad in accordance with the invention. However, the invention is not limited to these exemplary embodiments.

Figure 1:
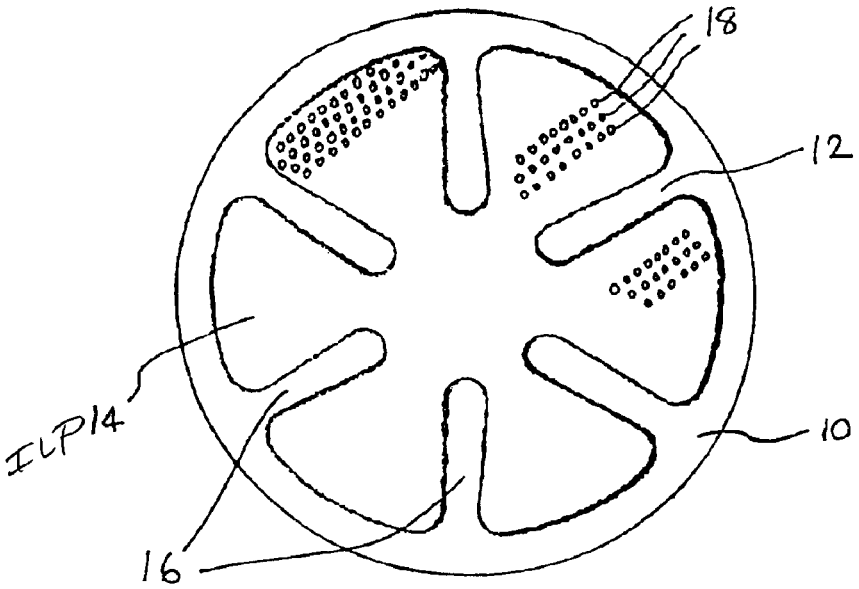
FIG. 1 shows a top view of a lens tool to which has been attached an intermediate lens pad.

FIG. 1 shows a single part die-cast aluminium alloy lens tool 10, which is generally circular when viewed from above, its upper main face 12 having a convex generally part-spherical curvature. A generally circular intermediate lens pad 14, made of plastics material, preferably polyvinyl chloride, is attached to the convex surface 12 by way of a glue. The pad 14 is provided with six slots 16 which are uniformly spaced apart around the center of the pad and extend radially from respective positions spaced a little way from the center of the pad, extending outwardly so as to be open at the periphery of the pad. This enables the pad to follow the curvature of the surface 12 more easily.

A multiplicity of through-holes 18 extend through the pad 14. These holes are uniformly distributed over the whole upper face of the pad 14, although only a few are illustrated in FIG. 1.

The diameter of the pad 14 is about 80 mm, and each hole is about 2 mm in diameter, with the minimum spacing between any two immediately adjacent holes being about 0.5 mm. The holes are arranged in a generally honeycomb formation.

The upper and lower main faces of the pad 14 are generally smooth.

Figure 2:
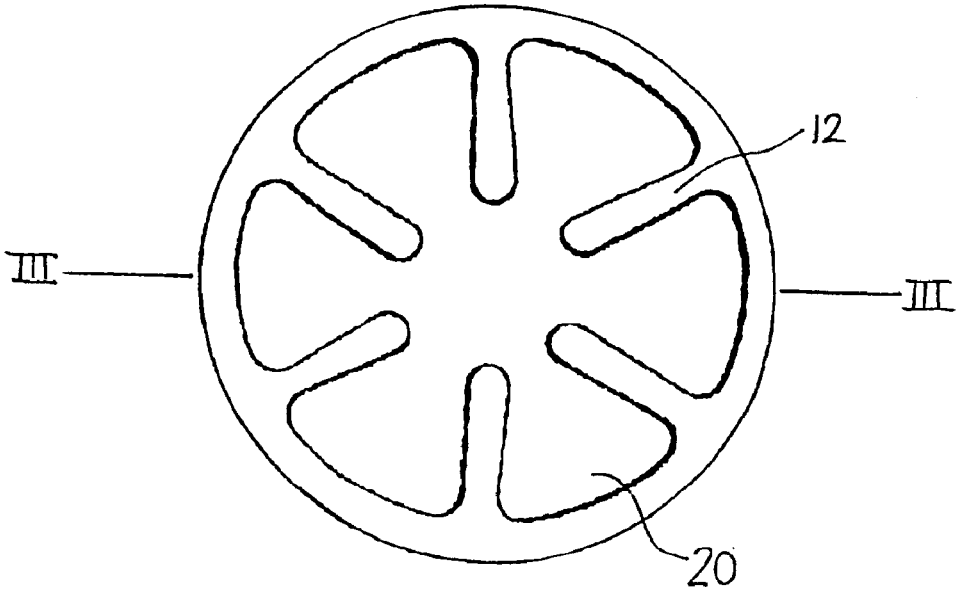
FIG. 2 shows a top view of the lens tool and intermediate pad combination shown in FIG. 1, with a surfacing pad attached thereto.
Figure 3:
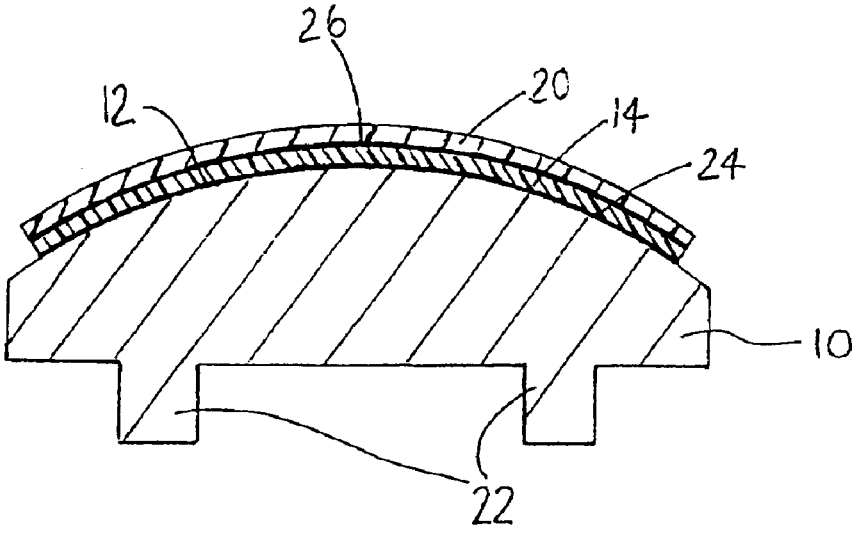
FIG. 3 shows a cross-sectional view through the lens tool and pads shown in FIG. 2 taken on the line III—III shown therein.

As shown in FIGS. 2 and 3, when the lens tool and intermediate pad shown in FIG. 1 are prepared for use, a lens surfacing pad 20, having substantially the same outline as the intermediate pad 14, is secured to the upper face thereof. Whilst in FIG. 2, the pad 20 is shown as completely obscuring the intermediate pad 14, it would be acceptable for the pad 20 to be arranged so that its slots are not in registration with those of the intermediate lens pad 14.

As is clearer from the cross-sectional view shown in FIG. 3, the lens tool 10 has on its underside mounting formations 22 to facilitate the mounting of the lens tool 10. The glue that secures the intermediate pad 14 to the upper convex surface 12 of the tool 10 is shown as a layer 24. The smoothing pad 20 is attached to the intermediate pad 14 by way of a peel-off adhesive layer 26 provided on the intended underside of the surfacing pad 20.

Figure 4:
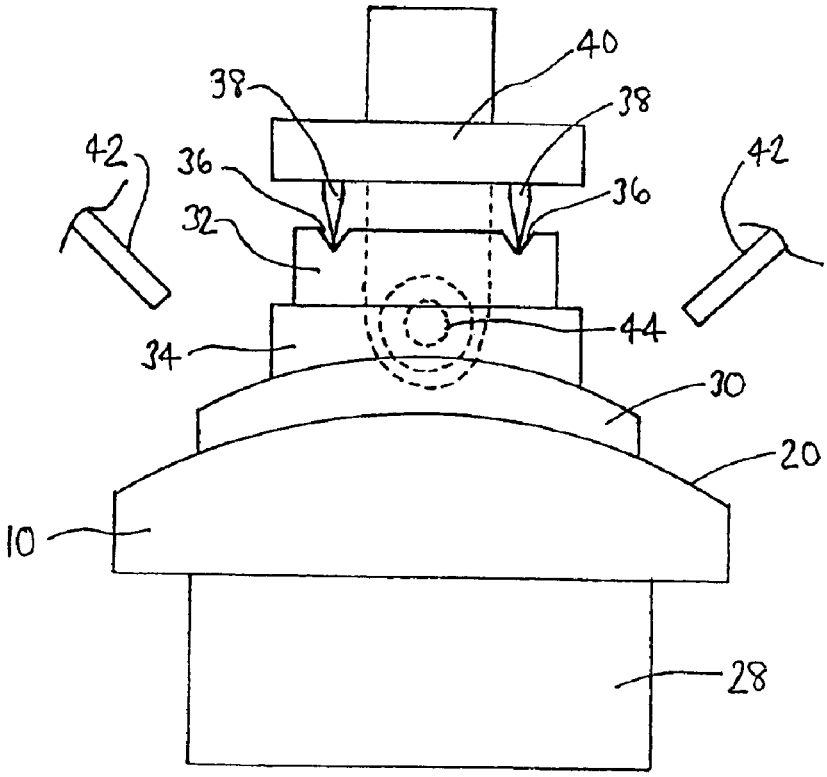
FIG. 4 shows an elevational view of a lens tool assembly including the lens and pad combination of FIGS. 2 and 3.

When the assembly shown in FIGS. 2 and 3 is prepared for use, it is mounted by way of the mounting formations 22 on a lens tool table 28 as shown in FIG. 4. A lens 30 is held on a lens holder 32 by way of a low-temperature meltable alloy 34. The lens holder 32 is provided with respective recesses 36 which receive respective drive pins 38 of a drive 40 so that the lens 30 is presented to the upper surface of the surfacing pad 20.

Respective outlets 42 are arranged to direct water or a slurry of abrasive and water on to the lens and lens tool.

Figure 5:
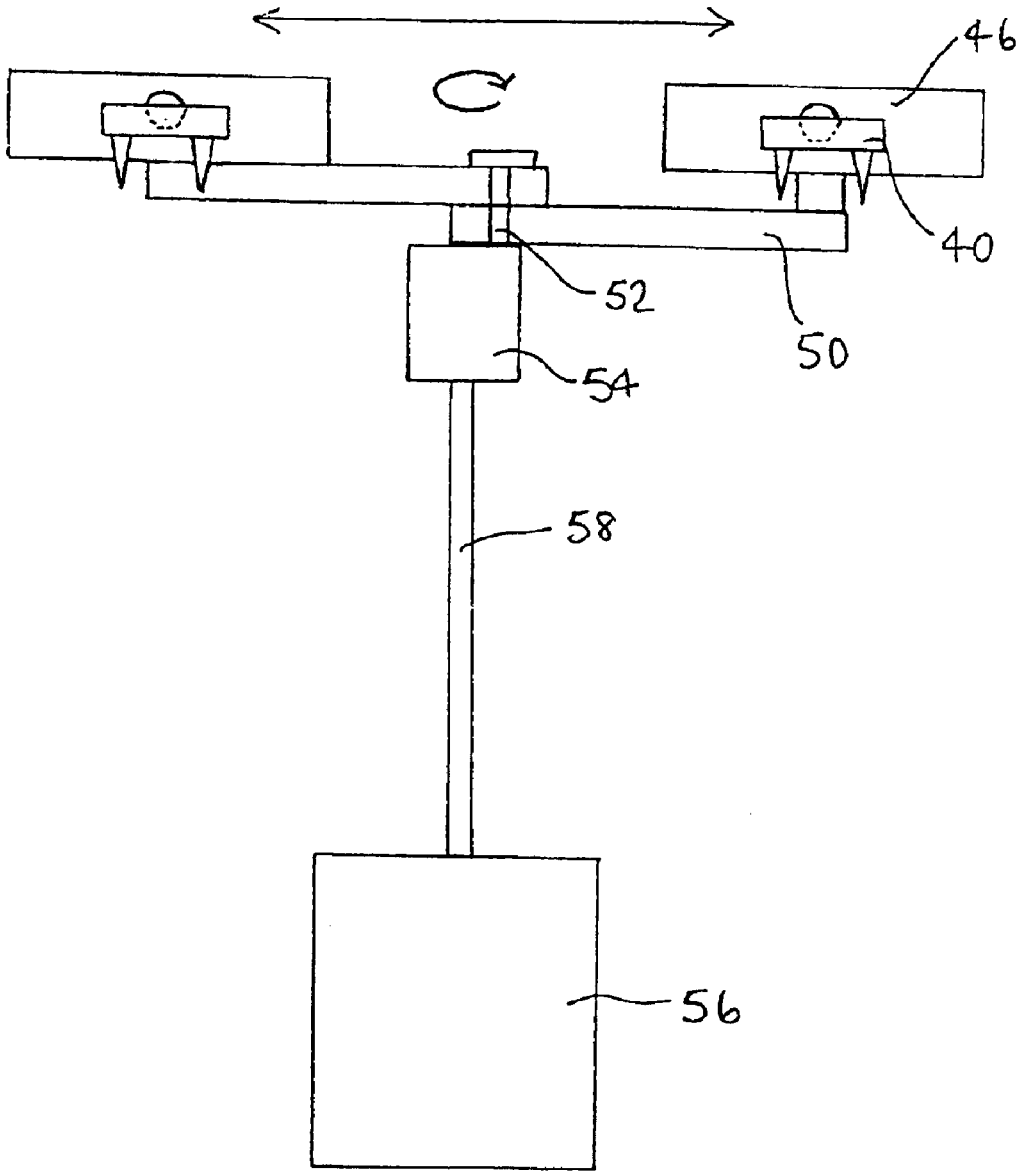
FIG. 5 shows a diagrammatic elevational view in greater detail of a part of the assembly shown in FIG. 4.
Figure 6:
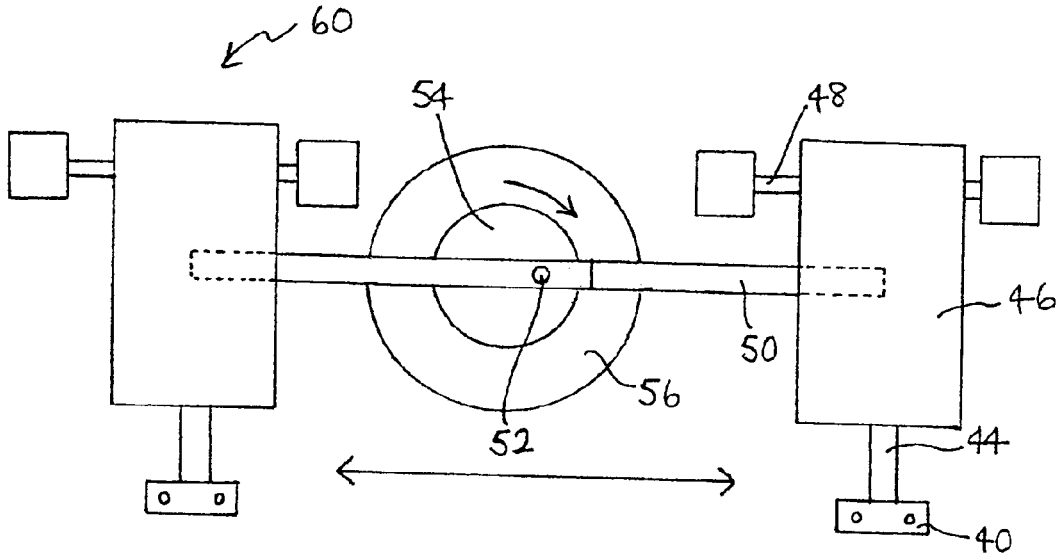
FIG. 6 shows a diagrammatic plan view of the part shown in FIG. 5.

The drive 40 is arranged by conventional means to perform a see-saw motion over the lens tool, by way of a device shown in FIGS. 5 and 6. This shows one way in which such a motion can be effected, the drive 40 being mounted on a shaft 44, which in turn is secured to the front end of a mounting block 46 slidably mounted on a guide 48. A connecting rod 50 is articulated to the block 46 at one end of the rod 50 and to a pin 52 at the other end. The pin 52 is eccentrically fixed on a cylinder 54 which in turn is rotated by a motor 56 via a drive shaft 58. A corresponding assembly 60 is arranged to be driven by the pin 52 on the other side thereof to the assembly comprising the mounting block 46.

During operation of the assembly shown in FIGS. 5 and 6, the motor 56 rotates to move the block 46 (via the shaft 58, the cylinder 54, the pin 52 and the rod 50) to-and-fro on the guide 48 which carries with it the drive 40.

At the same time, the lens tool table performs an orbital motion as viewed from above. The apparatus which effects such orbital motion is complex but is well-known in the art. An example of such apparatus is described and illustrated in U.S. Pat. No. 4,521,994. The whole contents of that patent specification are hereby imported into the present specification by way of direct reference.

After completion of this operation, the drive 40 may be raised by means not shown to enable the lens and the lens tool to be removed. The surfacing pad 20 may now be readily peeled-off from the intermediate pad 14, the presence of the holes 18, and the nature of the smooth upper surface of the intermediate pad 14 facilitating easy removal in this respect, in relation to systems which do not have an intermediate pad in accordance with the present invention, reducing the likelihood of repetitive strain injury to the user and increasing the speed with which the surfacing pad 20 can be removed. A further surfacing pad may now be secured in the same way to the intermediate pad 14, and the lens tool and lens can be replaced in the assembly shown in FIG. 4 for further surfacing of the lens 30. For example, the first surfacing pad may be a lapping pad and the second surfacing pad may be a polishing pad.

Numerous variations and modifications to the illustrated embodiment of the invention may be made without taking the resulting construction outside the scope of the present invention. For example, the intermediate pad 14 could be a wire mesh. Or, instead of having through-holes 18, it could simply have blind recesses of about the same size, or its smooth surface could instead be defined by the outer surfaces of a multiplicity of protuberances or islands spread uniformly across the pad. The curvature of the upper face or of the lens tool 10 may be toroidal. The number of slots 16 in the pad 14 or 20 may be other than six, for example, it may be four, seven, or eight.

The above description and accompanying drawings are only illustrative of exemplary embodiments, which can achieve the features and advantages of the invention. It is not intended that the invention be limited to the embodiments shown and described above. The invention can be modified to incorporate any number of variations, alterations, substitutions, or equivalent arrangements not heretofore described, but which are commensurate with the spirit and scope of the invention. The invention is only limited by the scope of the following claims.

We claim:

1. A method of surfacing a lens, said method comprising:

securing an intermediate lens pad to the curved surface of a lens tool;

peeling off a protective cover from an adhesive layer on one side of a lens surfacing pad and securing the lens surfacing pad with the adhesive layer to an upper surface of the intermediate lens pad;

surfacing a lens with a working surface of the lens surfacing pad, the adhesive layer inhibiting relative movement between the intermediate pad and the lens surfacing pad during surfacing, while facilitating ready manual removal of the surfacing pad for replacement by a different surfacing pad; and effecting such removal and replacement, and surfacing the lens or a different lens using the working surface of the replacement pad, wherein the intermediate lens pad has a plurality of slots spaced apart around the center of the pad, extending radially from positions spaced from the center of the pad and extending outwardly so as to be open at the periphery of the pad to enable the pad to follow the curvature of the lens tool, and wherein an outer surface of the intermediate lens pad is substantially smooth and comprises a multiplicity of holes or recesses substantially uniformly distributed over an entirety of the outer surface, said holes or recesses being at least an order of magnitude smaller than the intermediate lens pad.

2. A method of surfacing a lens, said method comprising:

securing an intermediate lens pad to the curved surface of a lens tool;

peeling off a protective cover from an adhesive layer on one side of a lens surfacing pad and securing the lens surfacing pad with the adhesive layer to an upper surface of the intermediate lens pad;

surfacing a lens with a working surface of the lens surfacing pad, the adhesive layer inhibiting relative movement between the intermediate pad and the lens surfacing pad during surfacing, while facilitating ready manual removal of the surfacing pad for replacement by a different surfacing pad; and effecting such removal and replacement, and surfacing the lens or a different lens using the working surface of the replacement pad, wherein the intermediate lens pad has a plurality of slots spaced apart around the center of the pad, extending radially from positions spaced from the center of the pad and extending outwardly so as to be open at the periphery of the pad to enable the pad to follow the curvature of the lens tool, and wherein an outer surface of the intermediate lens pad is substantially smooth and is defined by outer surfaces of a multiplicity of protuberances substantially uniformly distributed over the outer surface such that the distance between adjacent protuberances is an order of magnitude smaller than the intermediate lens pad.

* * * * *